US007855627B2

(12) United States Patent
Nishikawa et al.

(10) Patent No.: US 7,855,627 B2
(45) Date of Patent: Dec. 21, 2010

(54) COMMON-MODE CHOKE COIL

(75) Inventors: Yoshie Nishikawa, Tsim Sha Tsui (HK); Shinya Hirai, Kusatsu (JP); Takahiro Aoki, Moriyama (JP); Tetsuya Morinaga, Otsu (JP); Takahiro Azuma, Yokohama (JP); Yasushi Saito, Sagamihara (JP); Yoshimasa Goto, Sagamihara (JP); Yu Ishiwata, Yasu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/612,106

(22) Filed: Nov. 4, 2009

(65) Prior Publication Data

US 2010/0045418 A1 Feb. 25, 2010

Related U.S. Application Data

(63) Continuation of application No. PCT/JP2008/051826, filed on Feb. 5, 2008.

(30) Foreign Application Priority Data

May 14, 2007 (JP) ..... 2007-127793

(51) Int. Cl.
*H01F 5/00* (2006.01)
*H01F 27/28* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS 6,242,996 B1 6/2001 Sato et al.
6,348,850 B1 * 2/2002 Kimura et al. ..... 336/200
6,373,366 B1 * 4/2002 Sato et al. ..... 336/192

(Continued)

FOREIGN PATENT DOCUMENTS

JP 2000-133522 A 5/2000

(Continued)

OTHER PUBLICATIONS

Official Communication issued in International Patent Application No. PCT/JP2008/051826, mailed on May 13, 2008.

*Primary Examiner*—Anh T Mai
*Assistant Examiner*—Ronald W Hinson
(74) *Attorney, Agent, or Firm*—Keating & Bennett, LLP

(57) ABSTRACT

A common-mode choke coil has induction immunity characteristics that are improved by a coil structure preventing a transmitter IC and a receiver IC from malfunctioning during an induction immunity test and which controls a decrease in ESD resistance and a decrease in self-resonance frequency. The common-mode choke coil includes a core, external electrodes, a pair of coils, and a top plate. The core includes a core section and a pair of flange sections. The pair of coils are wound around the core section of the core, and the ends of the coils are connected to the external electrodes, respectively. An underside and a side surface of the top plate are plated with a metal film, and bonded to the top surfaces of the flange sections preferably by an adhesive agent. The metal film is segmented into two separate portions so as to define two separate metal sections with a gap therebetween so that the metal sections are electrically disconnected.

8 Claims, 9 Drawing Sheets

U.S. PATENT DOCUMENTS

| | | | | |
|---|---|---|---|---|
| 6,522,230 | B2 * | 2/2003 | Hanato et al. | 336/83 |
| 6,717,500 | B2 * | 4/2004 | Girbachi et al. | 336/83 |
| 7,312,682 | B2 * | 12/2007 | Yasuda et al. | 336/200 |
| 2002/0084878 | A1 * | 7/2002 | Kimura et al. | 336/83 |
| 2003/0071704 | A1 * | 4/2003 | Toi et al. | 336/83 |

FOREIGN PATENT DOCUMENTS

| | | | |
|---|---|---|---|
| JP | 2003-168611 | A | 6/2003 |
| JP | 2004-146671 | A | 5/2004 |
| JP | 2005-347407 | A | 12/2005 |
| JP | 2006-196492 | A | 7/2006 |
| JP | 2007-142931 | A | 6/2007 |

* cited by examiner

COMMON-MODE CHOKE COIL

BACKGROUND OF THE INVENTION

1. Field of the Invention

The present invention relates to a winding-type common-mode choke coil for removing a common-mode noise on a transmission line.

2. Description of the Related Art

Techniques disclosed in Japanese Unexamined Patent Application Publication No. 2003-168611 and Japanese Unexamined Patent Application Publication No. 2000-133522 are currently available for a common-mode choke coil.

The common-mode choke coil includes a core and two wires wound in a coil around a core section of the core. The core has flange sections at both ends thereof. The two ends of each of the coils are connected respectively to electrodes of the flange sections. A ferrite plate straddles the top sides of the flange sections.

Such a structure of the common-mode choke coil removes the common-code noise entering a differential transmission line or the like.

The known above-described common-mode choke coil has the following problem.

Before being sold as commercial products, the common-mode choke coils are typically subjected to an immunity test. In the immunity test, the coils are exposed to electromagnetic interferences likely to occur thereto in order to determine whether the coils withstand a variety of electromagnetic interferences.

In the immunity test of the common-choke coil to the common-mode noise, the common-mode coil as a test specimen is arranged at the front end of a receiver IC (Integrated Circuit) connected to a transmitter IC connected via a differential transmission line. A differential signal is transmitted from the transmitter IC to the receiver IC via the differential transmission line, and a common noise is induced in the differential transmission line to be superimposed on the differential signal. In this condition, the transmitter IC and the receiver IC are checked for any malfunction. Such an immunity test is referred to as an induction immunity test.

Since inductance of the common-mode choke coil as a test specimen and input capacitance of the receiver IC form a resonator circuit in the above-described known common-choke coil during the induction immunity test, the effectiveness of control of the common-mode noise is lowered at a resonance frequency of the resonator circuit and in a frequency band in the vicinity of the resonance frequency. In such a case, the transmitter IC and the receiver IC malfunction, and the test specimen may not pass the induction immunity test.

SUMMARY OF THE INVENTION

In view of the above, preferred embodiments of the present invention provide a common-mode choke coil which has induction immunity characteristics improved by a coil structure preventing a transmitter IC and a receiver IC from malfunctioning during an induction immunity test and which controls a decrease in ESD resistance and a decrease in self-resonance frequency.

According to a preferred embodiment of the present invention, a common-mode choke coil includes a magnetic core including a core section and first and second flange sections arranged at both ends of the core section, external electrodes located on each of the first and second flange sections, a pair of coils wound around the core section with each of the coils having one end starting at the first flange section and the other end terminated at the second flange section, the coils ends being routed to and connected to the external electrodes, and a magnetic plate with a surface thereof facing the pair of coils and bonded to side surfaces of the first and second flange sections. A metal film is formed on at least the surface of the magnetic plate facing the pair of coils. A gap is arranged in the metal film by segmenting the metal film into a first metal film section and a second metal film section with the first metal film section and the second metal film section being electrically disconnected, and corresponding to a winding starting portion and a winding terminating portion of the pair of coils, respectively.

With this arrangement, the metal film is disposed on at least the surface of the magnetic plate facing the pair of coils. Lines of magnetic force caused by currents in the pair of coils pass through the metal film and eddy currents are caused in the metal film. A resistance component increases to a noise at a resonance frequency of a resonator circuit and a noise in a frequency band in the vicinity of the resonance frequency. The resonator circuit includes an inductance of the common-mode choke coil as a test specimen and an input capacitance of the receiver IC caused during the induction immunity test. The common-mode noise is thus reduced. An excellent noise reduction effect is thus achieved on the noises in all the frequency bands in the induction immunity test.

The immunity tests include not only the induction immunity test but also an ESD (Electro Static Discharge) immunity test. In the ESD test, a high ESD voltage is applied between an input and an output of a component part to determine whether the component part is damaged or not.

Since the metal film is formed at least on the surface of the magnetic plate facing the pair of coils, there is a possibility that a capacitive coupling component caused between the winding starting portions of the coils and the magnetic plate and a capacitive coupling component between the winding terminating portions of the coils and the magnetic plate are directly electrically connected to each other by the metal film. If a high ESD voltage is applied to the winding starting portions of the pair of coils or to the winding terminating portions of the pair of coils in this condition, a high current flows to the metal film through the capacitance, damaging the coil. More specifically, the ESD robustness is lowered, and the choke coil may not pass the ESD immunity test. During use of a normal high-frequency signal, a current reaches the winding starting portions of the pair of coils and the winding terminating portions of the pair of coils via the metal film, impedance in a high-frequency region is lowered. There is a possibility that the self-resonance frequency of the common-mode choke coil is lowered.

In accordance with a preferred embodiment of the present invention, the gap is formed to segment the metal film into the first metal film section and the second metal film section, corresponding to the winding starting portion and the winding terminating portion of the pair of coils, respectively. The first metal film section and the second metal film section are electrically disconnected from each other. Almost no current flows from the coil side to the metal film side. Even if a high ESD voltage is applied, no damage is caused. A decrease in the self-resonance frequency resulting from a decrease in ESD robustness and an impedance decrease in the high frequency region is thus controlled.

The metal film is preferably made of an ferromagnetic body containing at least one selected from the group consisting of iron, cobalt, nickel, chromium, manganese, and copper, for example.

With this arrangement, excellent magnetic characteristics are achieved and maintained and a resistance component to noise is increased.

The metal film is preferably made of a ferromagnetic alloy containing as a main component one of an alloy of nickel and chromium and an alloy of nickel and copper, for example.

The gap preferably has a band-shaped configuration with the width direction thereof aligned with the winding axis direction of the pair of coils and the length direction thereof aligned with a direction perpendicular or substantially perpendicular to the winding axis direction of the pair of coils.

The gap is also preferably arranged at a center position between the winding starting portion and the winding terminating portion.

This arrangement effectively controls the current flowing into the metal film side.

Each of the magnetic core and the magnetic plate is preferably made of ferrite.

This arrangement improves magnetic characteristics of the common-mode choke coil.

An adhesive is used to bond the magnetic plate to side surfaces of the first and second flange sections.

The adhesive preferably contains magnetic powder.

This arrangement further improves magnetic characteristics of the common-mode choke coil.

Since the common-mode choke coil according to a preferred embodiment of the present invention includes the metal film arranged on at least the surface of the magnetic plate facing the pair of coils as described above, induction immunity characteristics of the common-mode choke coil are improved. As a result, a noise control effect controlling noise in all frequency bands in the induction immunity test is achieved. The gap is formed to segment the metal film into the first metal film section and the second metal film section, corresponding to the winding starting portion and the winding terminating portion of the pair of coils, respectively. The first metal film section and the second metal film section are electrically disconnected from each other. Almost no current flows from the coil side to the metal film side. A decrease in the self-resonance frequency resulting from a decrease in ESD robustness and an impedance degrease in the high frequency region is controlled.

Thus, a common-mode choke coil according to a preferred embodiment of the present invention increases the resistance to noise, thereby further improving the noise control effect.

A common-mode choke coil according to another preferred embodiment of the present invention effectively prevents the current from flowing into the metal film side, thereby improving the control effect of controlling the self-resonance frequency decrease.

A common-mode choke coil according to an additional preferred embodiment of the present invention further improves the magnetic characteristics of the common-mode choke coil.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Preferred embodiments of the present invention will now be described with reference to the drawings.

Preferred Embodiment 1

Figure 1:
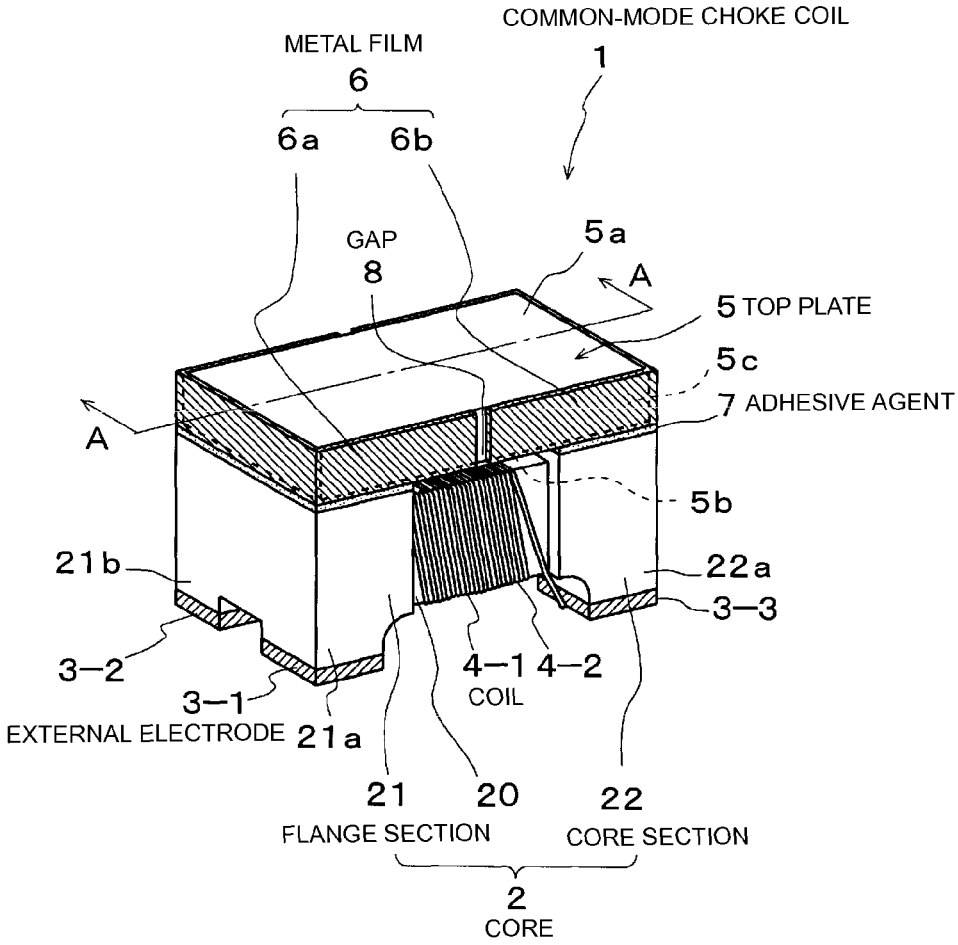
FIG. 1 is a perspective view illustrating a common-mode choke coil in accordance with a preferred embodiment of the present invention.
Figure 2:
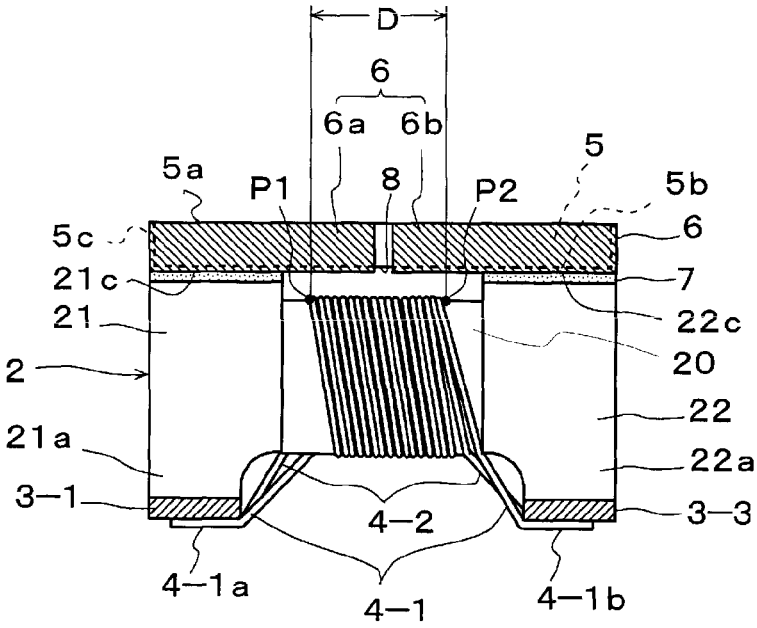
FIG. 2 is a front view of the common-mode choke coil of a preferred embodiment of the present invention.
Figure 3:
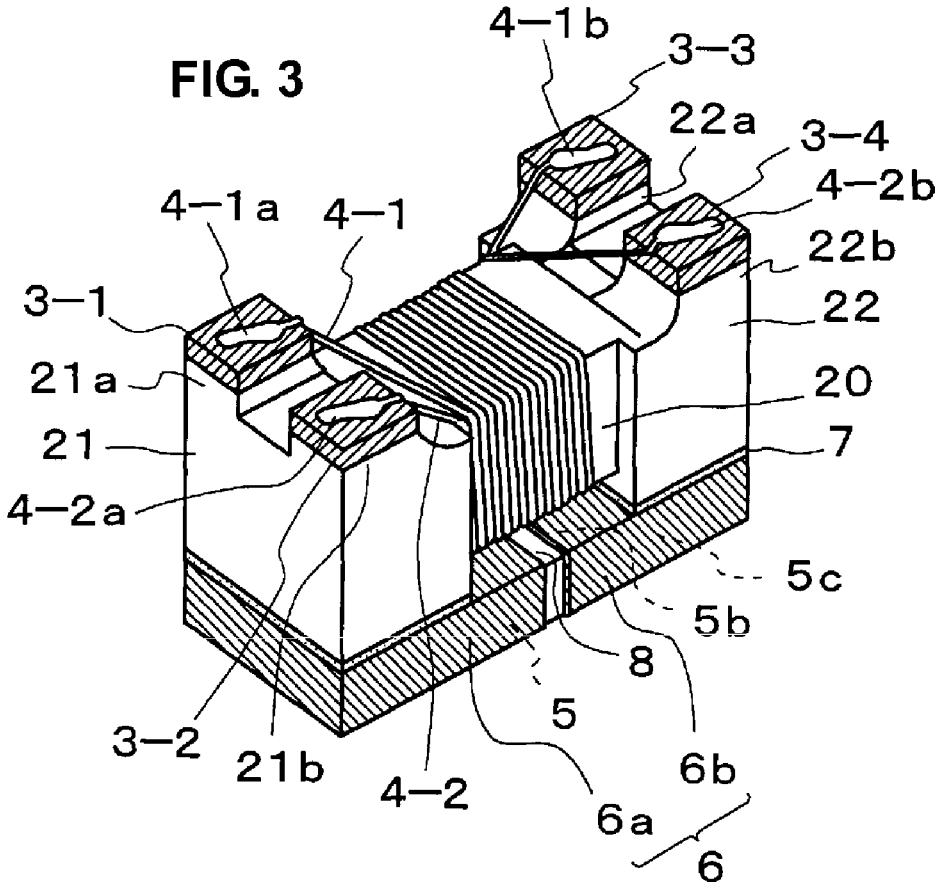
FIG. 3 is a perspective view illustrating the underside of the common-mode choke coil.

FIG. 1 is a perspective view illustrating a common-mode choke coil in accordance with one preferred embodiment of the present invention. FIG. 2 is a front view of the common-mode choke coil of the present preferred embodiment. FIG. 3 is a perspective view illustrating the underside of the common-mode choke coil.

The common-mode choke coil 1 is a wound-wire coil of surface-mount type, and includes, a core 2 as a magnetic core, four external electrodes 3-1 through 3-4, a pair of coils 4-1 and 4-2, and a top plate 5 as a magnetic plate as illustrated in FIGS. 1 and 2.

The core 2 is preferably made of ferrite such as Ni—Zn based ferrite, and includes a center core section 20 and a flange section 21 as a first flange and a flange section 21 as a second flange arranged at both ends of the core section 20.

The external electrodes 3-1 through 3-4 are arranged on the underside of the flange sections 21 and 22.

More specifically, the external electrodes 3-1 and 3-2 are respectively arranged on feet 21*a* and 21*b* and the external electrodes 3-3 and 3-4 are respectively arranged on feet 22*a* and 22*b* as illustrated in FIG. 3.

The pair of coils 4-1 and 4-2 are manufactured preferably by coating copper wires with insulation layers and wound around the core section 20 of the core 2. More specifically, the pair of coils 4-1 and 4-2 are wound around the core section 20, starting at a winding starting point P1 on the flange section 21 and terminating at a winding terminal point P2 on the flange section 22. As illustrated in FIG. 3, end portions 4-1*a* and 4-2*a* of the coils 4-1 and 4-2 are routed to the external electrodes 3-1 and 3-2 and connected respectively to the external electrodes 3-1 and 3-2. End portions 4-1*b* and 4-2*b* of the coils 4-1 and 4-2 are routed to the external electrodes 3-3 and 3-4 and connected respectively to the external electrodes 3-3 and 3-4.

The top plate 5 illustrated in FIG. 1 is preferably made of ferrite such as Mn—Zn based ferrite, Ni—Zn based ferrite, or the like. As illustrated in FIG. 2, a metal film 6 is disposed on an underside 5*b* facing the coils 4-1 and 4-2 and a side surface 5*c*.

The metal film 6 is preferably made of a ferromagnetic body containing at least one selected from the group consisting of iron, cobalt, nickel, chromium, manganese, and copper, for example. More preferably, the metal film 6 is preferably made of a ferromagnetic alloy containing as a main component one of an alloy of nickel and chromium and an alloy of nickel and copper, for example.

The top plate 5 having the metal film 6 coated thereon straddles on top surfaces 21*c* and 22*c* as side surfaces of the flange sections 21 and 22 and is bonded onto theses top surfaces 21*c* and 22*c* preferably by an adhesive 7, for example. Magnetic powder may be mixed with the adhesive 7, for example. With the magnetic powder mixed, the adhesive 7 not only bonds the top plate 5 to the core 2 but also improves magnetic characteristics between the top plate 5 and the core 2.

A gap 8 preferably is arranged in the metal film 6 of the top plate 5.

Figure 4:
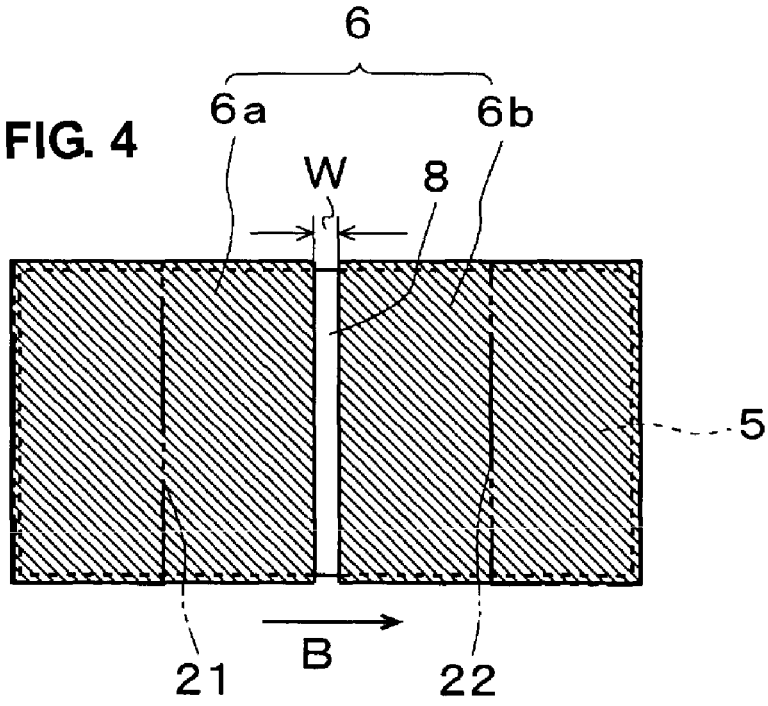
FIG. 4 is a bottom view illustrating the shape of a gap and the formation position thereof.

FIG. 4 is a bottom view of the top plate 5 illustrating the shape and installation position of the gap 8.

As illustrated in FIG. 4, an arrow B denotes the winding axis direction of the pair of coils 4-1 and 4-2 and the gap 8 has a band-shaped configuration with the width W direction thereof aligned with the winding axis direction B and the length direction thereof aligned to be perpendicular or substantially perpendicular to the winding axis direction B. The gap 8 extends from the underside 5*b* to the side surface 5*c* of the top plate 5 as illustrated in FIG. 2. The metal film 6 on the top plate 5 is thus segmented into two separate portions by the gap 8.

More specifically, the gap 8 is formed at the center position of a region D between a portion of the metal film 6 corresponding to the winding starting point P1 of the pair of coils 4-1 and 4-2 and a portion of the metal film 6 corresponding to the winding terminal point P2 of the pair of coils 4-1 and 4-2. The metal film 6 is thus segmented into a metal film section 6*a* as a first metal film and a metal film section 6*b* as a second metal film so that the metal film sections 6*a* and 6*b* are electrically disconnected from each other.

The functions of the metal film 6 and the gap 8 are described below.

Figure 5:
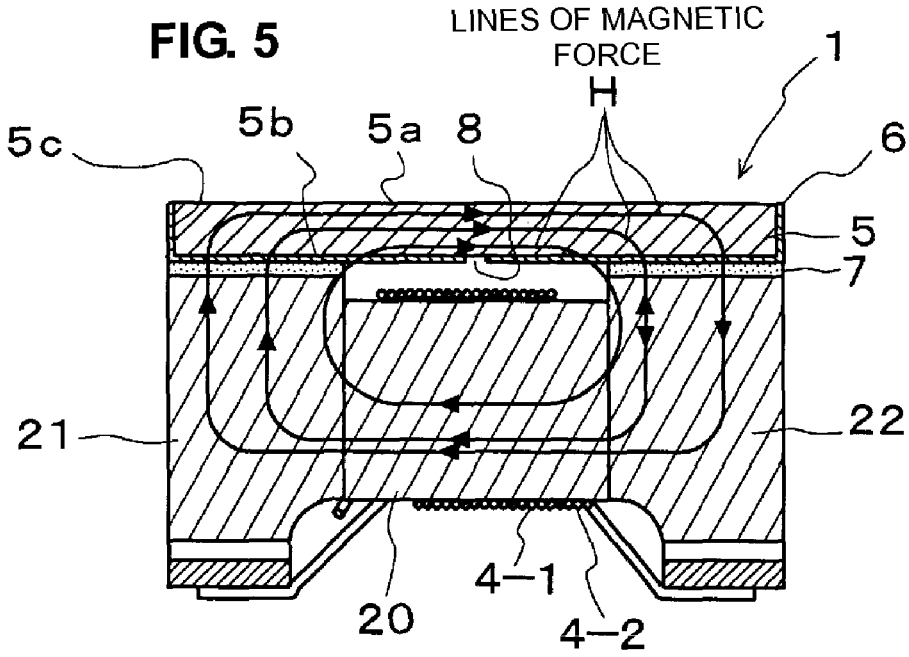
FIG. 5 is a sectional view taken along arrow-headed line A-A in FIG. 1 illustrating the function of a metal film.
Figure 6:
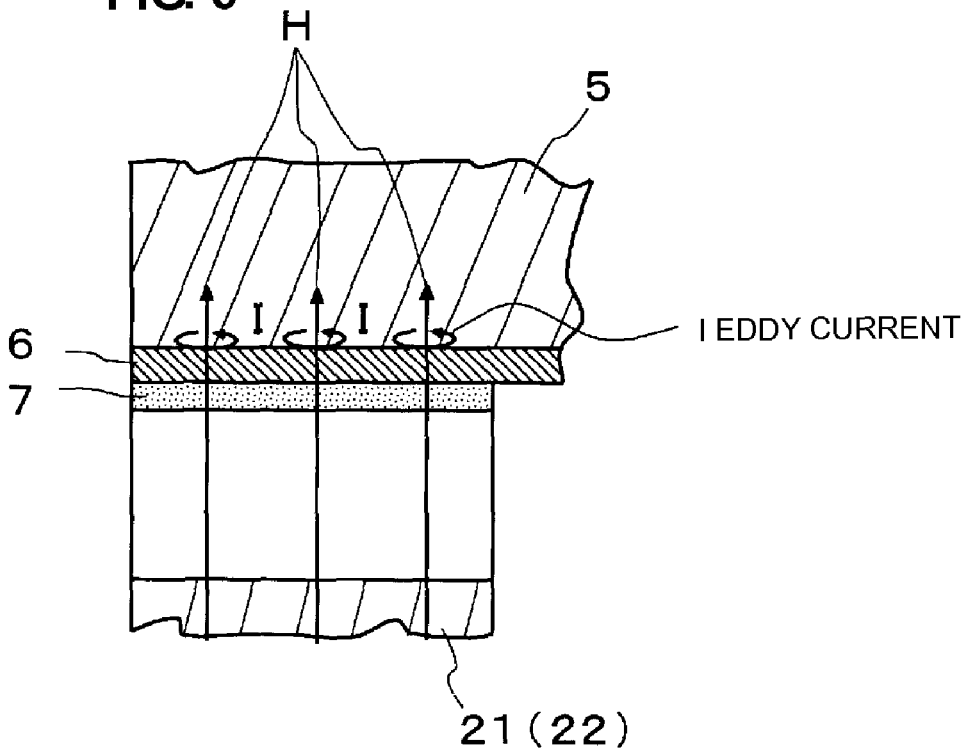
FIG. 6 is a partial expansion view illustrating an eddy current generated in the metal film.

FIG. 5 is a sectional view taken along arrow headed line A-A in FIG. 1 illustrating the function of the metal film 6 and FIG. 6 is a partial expansion view illustrating eddy currents I generated in the metal film 6.

When the common-mode choke coil 1 having the above-described structure receives a signal of a predetermined frequency, lines of magnetic force H responsive to the signal are generated through the core section 20, the flange sections 21 and 22, and the top plate 5 as denoted by arrows in FIG. 5.

A resistor unit 6 is arranged in a region through which the lines of magnetic force H passes, and functions as a resistance component of the common-mode choke coil 1.

More specifically, the lines of magnetic force H running from the flange section 21 (22) to the top plate 5 pass through the metal film 6 of the resistor unit 6 as illustrated in FIG. 6, thereby generating the eddy currents I on the surface of the metal film 6. As a result, energy of the signal flowing through the pair of coils 4-1 and 4-2 (see FIG. 5) is consumed, and the metal film 6 functions as a resistance to the signal flowing through the pair of coils 4-1 and 4-2.

FIG. 7 is a partial expansion view illustrating the function of the gap 8.

Figure 7A:
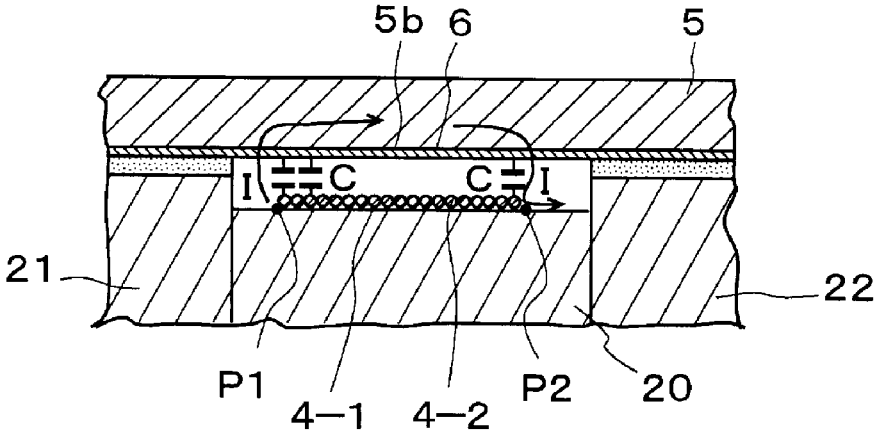
FIGS. 7A-7C are partial expansion views illustrating the function of the gap.

The metal film 6 is formed on the underside 5*b* of the top plate 5, and faces the pair of coils 4-1 and 4-2 in the common-mode choke coil 1 of the present preferred embodiment. As illustrated in FIG. 7A, capacitance C is generated between the metal film 6 and the pair of coils 4-1 and 4-2, and the current I flowing to the pair of coils 4-1 and 4-2 attempts to flow to the metal film 6 via the capacitance C. As shown, if the metal film 6 continuously extends in the winding axis direction of the pair of coils 4-1 and 4-2, the current I flows into the metal film 6 from the winding starting point P1 via the capacitance C and flows through the metal film 6 and out of the metal film 6 from the winding terminal point P. More specifically, there is a possibility that the current I input to the common-mode choke coil 1 flows out via the metal film 6 instead of flowing through the pair of coils 4-1 and 4-2. If a high ESD voltage is applied to the winding starting point P1 or the winding terminal point P2 of each of the pair of coils 4-1 and 4-2 in this condition, a high current I flows into the metal film 6 via the capacitance C, possibly damaging the metal film 6. More specifically, the presence of the metal film 6 can lower the ESD robustness. Even during normal use, the current I reaches the winding starting point P1 or the winding terminal point P2 of the pair of coils 4-1 and 4-2 via the metal film 6. Impedance in the high frequency region drops, possibly causing the self-resonance frequency of the common-mode choke coil 1 to be lowered.

Figure 7B:
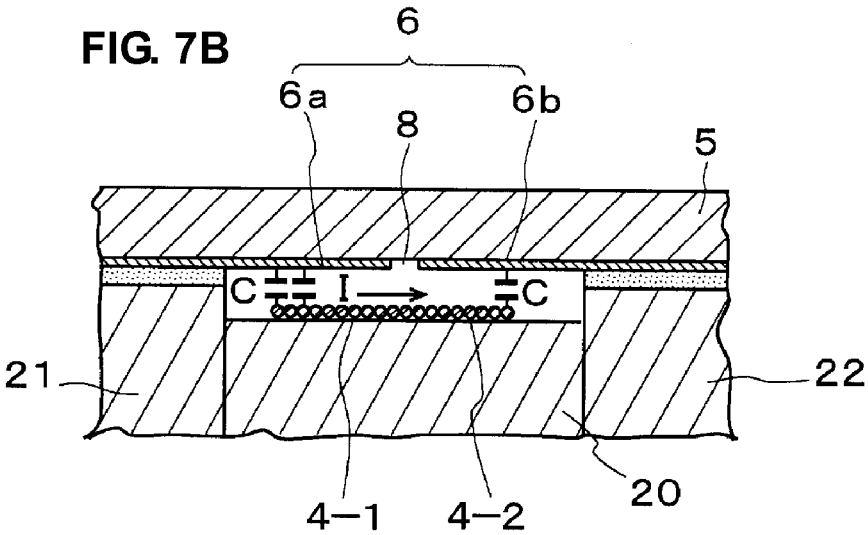

In contrast, in the common-mode choke coil 1 of the present preferred embodiment, the gap 8 segments the metal film 6 into the metal film sections 6*a* and 6*b*, thereby electrically disconnecting the metal film sections 6*a* and 6*b* from each other as illustrated in FIG. 7B. The current I does not flow to the metal film 6, but flows normally through the pair of coils 4-1 and 4-2. As a result, the ESD robustness is not lowered. There is almost no decrease in the self-resonance frequency caused by an impedance decrease in the high frequency range.

Figure 7C:
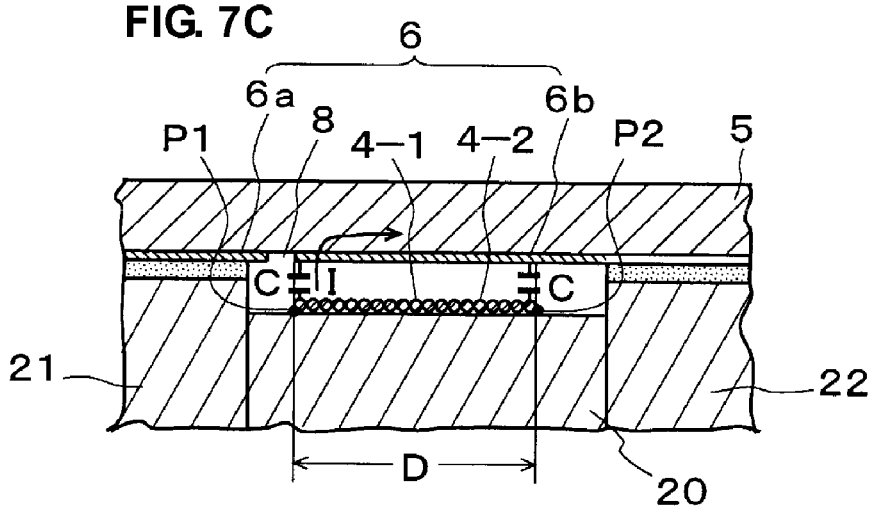

If the gap 8 is formed out of the region D between the winding starting point P1 and the winding terminal point P2 as illustrated in FIG. 7C, the winding starting point P1 of each of the coils 4-1 and 4-2 becomes close to the metal film section 6*b* of the metal film 6, and the current I flows to the metal film section 6*b*. The gap 8 needs to be formed within the region D. In accordance with the present preferred embodiment, the gap 8 is formed at the center of the region D, farthest apart from the winding starting point P1 and the winding terminal point P2 of each of the pair of coils 4-1 and 4-2 so that the intrusion of the current I into the metal film 6 is effectively controlled.

The metal film 6 is segmented into two separate portions by the gap 8 as illustrated in FIG. 7B. If the width W of the gap 8 is too narrow with respect to a voltage driving the current I, a discharge may take place between the metal film sections 6*a* and 6*b*, and the current I may flows across the metal film sections 6*a* and 6*b*.

The inventors of this invention examined the relationship between the ESD voltage triggering a charge and the width W of the gap 8 by conducting a test.

Figure 8:
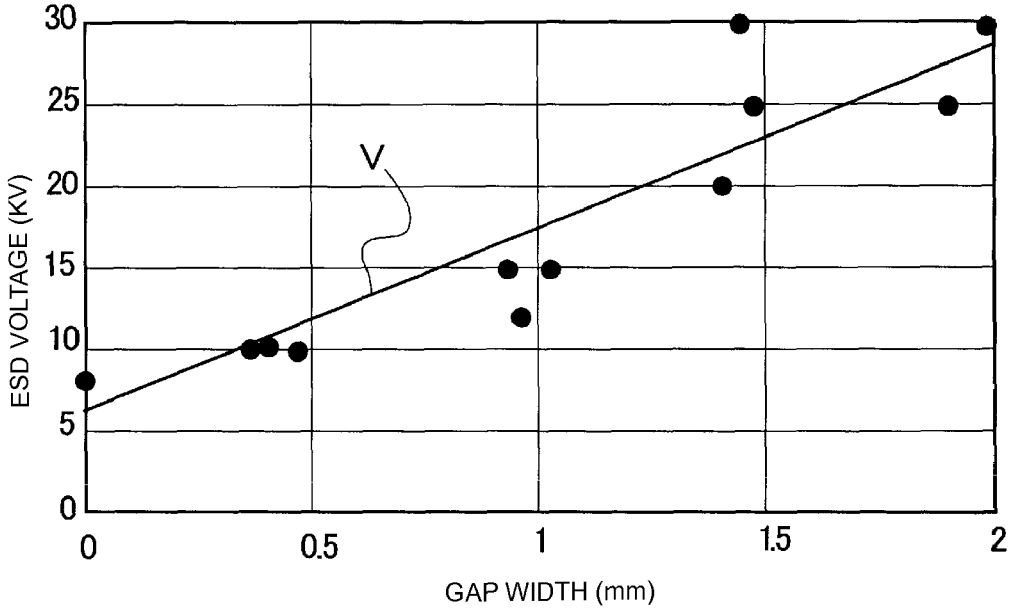
FIG. 8 is a plot of the relationship between an ESD voltage and a gap width.

FIG. 8 is a plot of the relationship between the ESD voltage and the gap width.

In this test, the length (the length in the left-right direction in FIG. 4) and the width (the length in the vertical direction in FIG. 4) of the top plate 5 having the metal film 6 thereon were set to be about 4.5 mm and about 3.2 mm, respectively, and the width W of the gap 8 was varied between 0.0 mm and about 2.0 mm, for example. The ESC voltage with the current I flowing through the metal film 6 at each width W was measured and plotted.

As illustrated in FIG. 8, the ESD voltage was plotted as a straight line V with respect to the width W of the gap 8. In the present preferred embodiment, the width W of the gap 8 is set to be between about 0.5 mm and about 2.0 mm so that the common-mode choke coil 1 withstands an ESD voltage of about 6 KV to about 30 KV, for example.

A manufacturing method of the common-mode choke coil 1 having the above-described structure is described below.

FIGS. 9A-9D illustrate a first process step of the manufacturing method of the common-mode choke coil 1. FIGS. 10A and 10B illustrate a second process step of the manufacturing method of the common-mode choke coil 1.

Figure 9A:
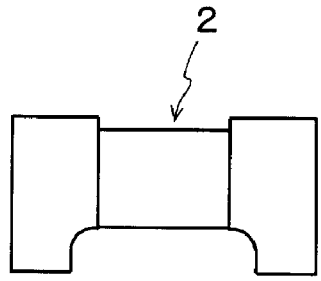
FIGS. 9A-9D illustrate a first process step of a manufacturing method of the common-mode choke coil.
Figure 9B:
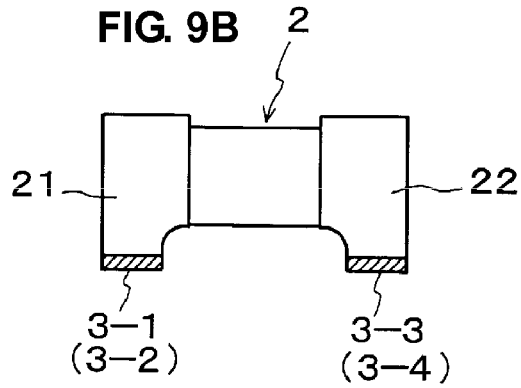
Figure 9C:
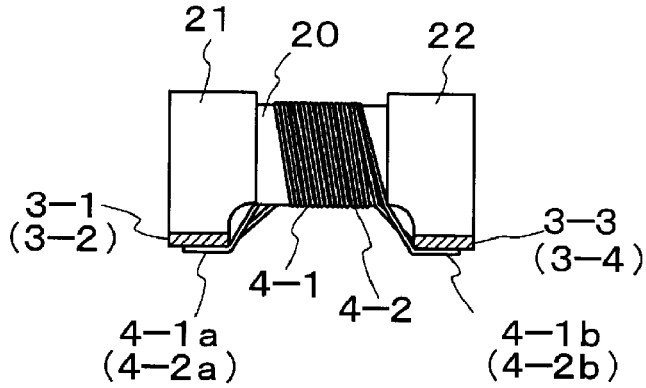
Figure 9D:
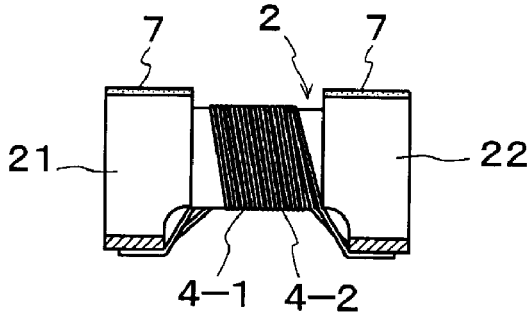
Figure 10A:
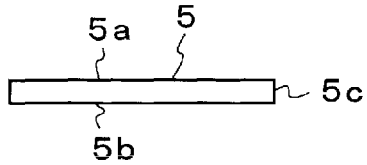
FIGS. 10A and 10B illustrate a second process step of the manufacturing method of the common-mode choke coil.
Figure 10B:
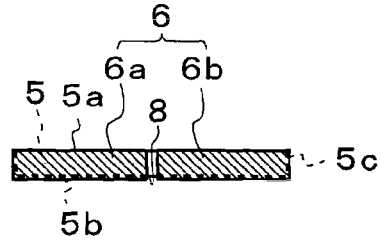

The first process step is a step for manufacturing the main body of the common-mode choke coil as illustrated in FIGS. 9A-9D. More specifically, as illustrated in FIG. 9A, the external electrodes 3-1 through 3-4 are applied on the undersides of the flange sections 21 and 22 of the core 2. As illustrated in FIG. 9C, the coils 4-1 and 4-2 are wound around the core section 20, and the end portions 4-1*a* and 4-2*a* and the end portions 4-1*b* and 4-2*b* are respectively connected to the external electrodes 3-1 and 3-2 and the external electrodes 3-3 and 3-4. The adhesive 7 is then applied on the top surfaces of the flange sections 21 and 22 as illustrated in FIG. 9D.

The second process step is a step for manufacturing the top plate 5, and is performed in parallel with the first process step.

More specifically, the top plate 5 is formed as illustrated in FIG. 10A. As illustrated in FIG. 10B, the metal film 6 and the gap 8 are formed on the underside 5*b* and the side surface 5*c* of the top plate 5 using a process such as plating or other suitable process.

Subsequent to the first and second process steps, the top plate 5 with the metal film 6 produced in the first process step is bonded to the top surfaces of the flange sections 21 and 22 of the core 2 produced in the first process step preferably using the adhesive 7. The common-mode choke coil 1 is thus produced.

The operation and advantage of the common-mode choke coil of the present preferred embodiment are described below.

Figure 11:
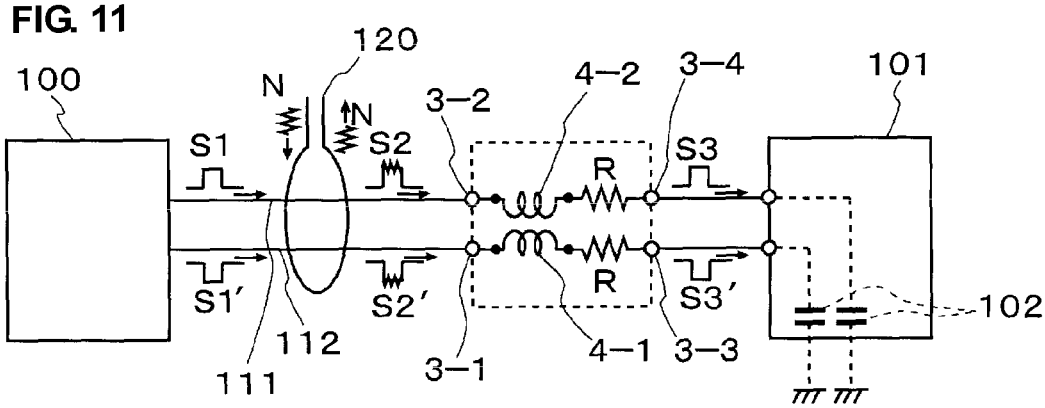
FIG. 11 is a block diagram generally illustrating the operation and advantage of the common-mode choke coil in an induction immunity test.

FIG. 11 is a block diagram illustrating generally the operation and advantage of the common-mode choke coil 1 in the induction immunity test.

Referring to FIG. 11, reference numerals 100 and 101 represent a transmitter IC and a receiver IC. The transmitter IC 100 and the receiver IC 101 are connected via differential transmission lines 111 and 112. A noise generator 120 for generating a common-mode noise N is arranged on the differential transmission lines 111 and 112 on the side of the transmitter IC 100.

The common-mode choke coil 1 is connected in series with a point of the differential transmission lines 111 and 112 closer to the receiver IC 101. More specifically, the external electrodes 3-2 and 3-4 are connected to the differential transmission line 111 and the external electrodes 3-1 and 3-3 are connected to the differential transmission line 112.

Differential signals S1 and S1' are output from the transmitter IC 100 to the differential transmission lines 111 and 112 and the noise generator 120 is used to induce the common-mode noise N within a predetermined frequency band on the differential transmission lines 111 and 112.

Differential signals S2 and S2' containing the common-mode noise N are transmitted to the common-mode choke coil 1 and input to the common-mode choke coil 1 via the external electrodes 3-1 and 3-2. The differential signals S2 and S2' pass through the coils 4-1 and 4-2 and resistors R and R, and are then output to the differential transmission lines 111 and 112 as differential signals S3 and S3' via the external electrodes 3-3 and 3-4.

The capacitance at the terminal as the receiver IC 101 is the sum of numerous capacitances caused at the terminal. For understanding of the invention, these capacitances are represented by a capacitance 102. Since the capacitance 102 is present at the terminal of the receiver IC 101, the inductance of the coils 4-1 and 4-2 of the common-mode choke coil 1 and the capacitance 102 define a resonator circuit. The resonance frequency of the resonator circuit can fall within the frequency range of the common-mode noise N generated by the noise generator 120. Under this condition, the resonance frequency and the common-mode noise N within the frequency band in the vicinity of the resonance frequency cannot be sufficiently reduced, and the differential signals S3 and S3' with the common-mode noise N superimposed thereon can be output.

The metal film 6 is disposed on the underside 5*b* and the side surface 5*c* of the top plate 5 in the common-mode choke coil 1 of the present preferred embodiment so that the lines of magnetic force H pass reliably through the metal film 6 as illustrated in FIGS. 5 and 6. The generation of the eddy currents I in the metal film 6 increases the resistance component R to the common-mode noise N at the resonance frequency and in the frequency band in the vicinity of the resonance frequency. The resistance component R reduces the common-mode noise N. As a result, an excellent noise control effect is achieved on the common-mode noise N in all frequency bands in the induction immunity test.

Since the metal film 6 of the common-mode choke coil 1 faces the pair of coils 4-1 and 4-2, there is a possibility that the current flows through to the metal film 6 as illustrated in FIGS. 7A-7C and lowers the ESD robustness of the common-mode choke coil 1 and the impedance within a high frequency region. As previously discussed, in the common-mode choke coil 1 of the present preferred embodiment, the gap 8 causes an electrical disconnection state in the metal film 6 and is preferably located in the center of the region D farthest apart from the winding starting point P1 and the winding terminal point P2 of each of the pair of coils 4-1 and 4-2. The intrusion of the current into the metal film 6 is effectively controlled, and the decrease in the ESD robustness and the decrease in the impedance in the high frequency region are controlled.

The inventors of this invention conducted the following test to verify the control effect on the impedance drop in the high frequency region.

Figure 12:
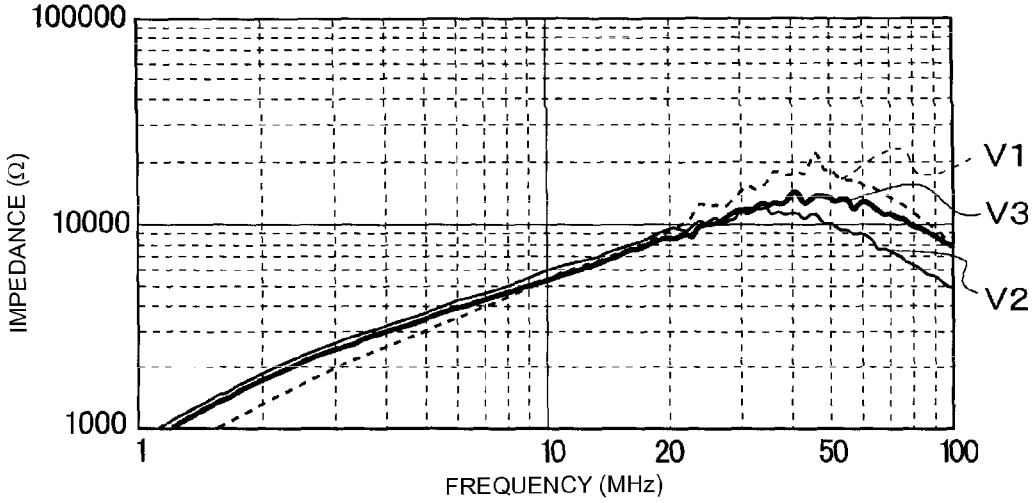
FIG. 12 is a graph illustrating the correlation between frequency and impedance measured in the test.
Figure 13A:
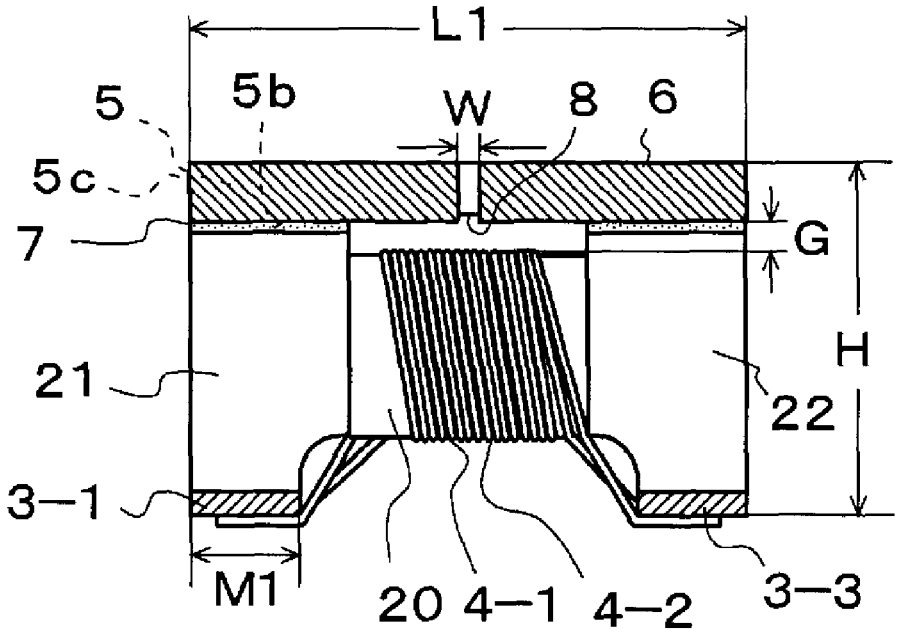
FIGS. 13A and 13B illustrate dimensions of the common-mode choke coil used in the test.
Figure 13B:
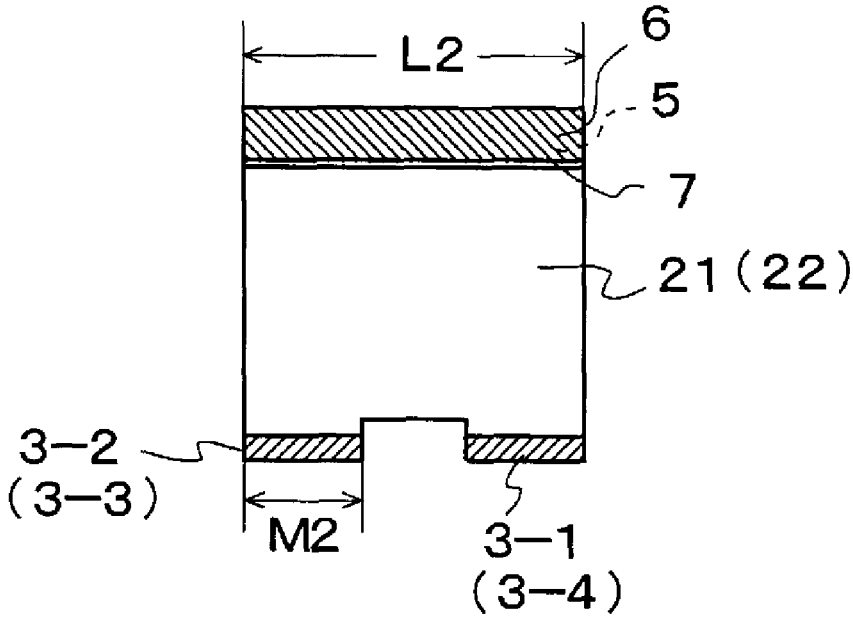

FIG. 12 illustrates a correlation between the frequency and impedance measured in the test, and FIGS. 13A and 13B illustrate dimensions of the common-mode choke coil used in the test.

In this test, a signal within a range of 1 MHz to 100 MHz was input to the common-mode choke coil without the metal film 6 and the impedance (Ω) at each frequency was measured.

More specifically, referring to FIGS. 13A and 13B, the common-mode choke coil was produced within a dimensional tolerance range of ±0.2 mm. In the common-mode choke coil, a length L1, a width L2, and a height H were 4.5 mm, 3.2, mm, and 2.6 mm, respectively, a vertical length M1 and a horizontal length M2 of the external electrode 3-1 (3-2 through 3-4) were 0.6 mm and 0.8 mm, respectively, a gap G between the pair of coils 4-1 and 4-2 and the top plate 5 is 0.1 mm, and the number of turns of each of the pair of coils 4-1 and 4-2 was 15 turns. The signal within the above described frequency was input to the common-mode choke coil. An impedance curve V1 represented by a broken line illustrated in FIG. 12 was obtained.

Since the common-mode choke coil is without the metal film 6, all input signals flow through the pair of coils 4-1 and 4-2. The common-mode choke coil is at a high-impedance state of 8000Ω-20000Ω in the high frequency region of 20 MHz to 100 MHz as represented by the impedance curve V1.

The same test was performed on the common-mode choke coil with the metal film 6 disposed on the underside 5*b* and the side surface 5*c* of the top plate 5. An impedance curve V2 denoted by a solid line illustrated in FIG. 12 was obtained. The common-mode choke coil has the metal film 6 without the gap 8. The input signal flows to the metal film 6 and the common-mode choke coil is at a low-impedance state of 5000Ω-about 10000Ω in the high frequency region of 20 MHz to 100 MHz as represented by the impedance curve V2.

The same test was also performed on the common-mode choke coil having the metal film 6 with the gap 8 of a width W of 2.0 mm formed in the center as illustrated in FIGS. 13A and 13B. An impedance curve V3 denoted by a heavy solid line illustrated in FIG. 12 was obtained. Since the gap 8 is formed in the metal film 6 in the common-mode choke coil, the intrusion of the input signal to the metal film 6 is controlled and the common-mode choke coil is within about 8000Ω-about 13500Ω in the high frequency region of 20 MHz to 100 MHz as represented by the impedance curve V3. The inventors have thus verified that the use of the metal film 6 having the gap 8 controls the impedance decrease in the high frequency region.

The present invention is not limited to the above preferred embodiments, and a variety of modifications and changes are possible within the scope of the present invention.

Figure 14A:
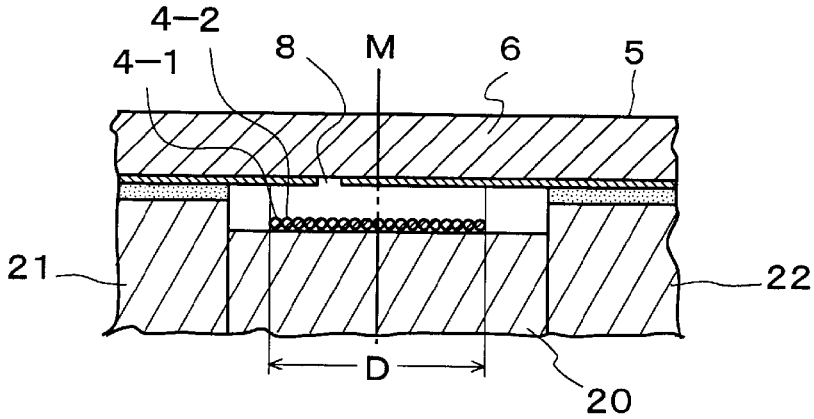
FIGS. 14A and 14B are partial expansion views illustrating one modification of a preferred embodiment of the present invention.
Figure 14B:
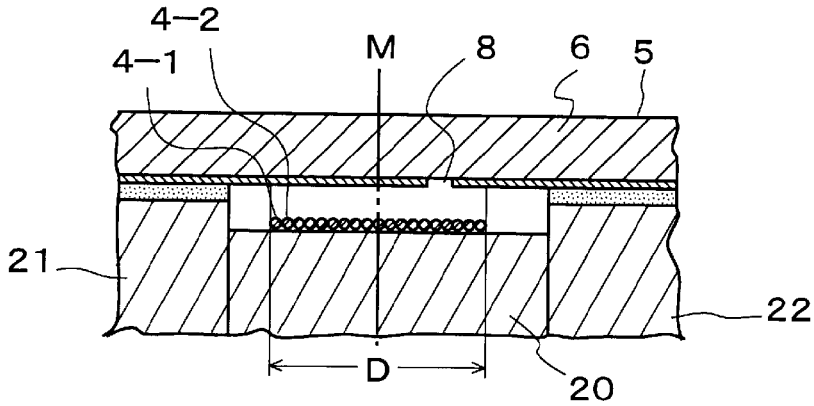

For example, the gap 8 is preferably formed at the center of the region D of the winding starting point P1 and the winding terminal point P2 as illustrated in FIG. 7B. It is sufficient if the gap 8 is formed within the region D. As illustrated in FIGS. 14A and 14B, the common-mode choke coil having the gap 8 laterally shifted from the center position M within the region D also falls within the scope of the present invention.

Figure 15:
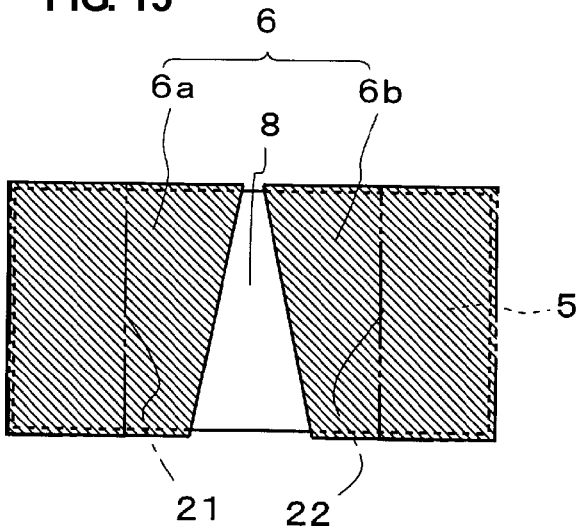
FIG. 15 is a plan view illustrating another modification of a preferred embodiment of the present invention.

In the above-referenced preferred embodiments, the gap 8 preferably has a band-shaped configuration with a constant width as illustrated in FIG. 4. The shape of the gap 8 is optional. As illustrated in FIG. 15, the common-mode choke coil with the gap 8 having a trapezoidal shape if viewed from the rear side of the top plate 5 also falls within the scope of the present invention.

In the above preferred embodiments, the metal film 6 is preferably disposed on the underside 5*b* and the side surface 5*c* of the top plate 5 other than the top surface 5*a*. It is sufficient if the metal film 6 is disposed at least on the underside 5*b*. The common-mode choke coil having the metal film 6 only on the underside 5*b* of the top plate 5 and the common-mode choke coil having the metal film 6 covering the entire the top plate 5 including the top surface 5*a* also fall within the scope of the present invention.

In the above preferred embodiments, the core 2 and the top plate 5 are preferably made of ferrite. This is not intended to mean that a common-mode choke coil having the core 2 and the top plate 5, made of a magnetic material other than ferrite, is excluded from the scope of the present invention.

In the above preferred embodiments, the external electrodes 3-1 through 3-4 are directly applied on the flange sections 21 and 22. This is not intended to mean that the common-mode choke coil having the flange section 2 having a metal terminal for the external electrode is excluded from the scope of the present invention.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A common-mode choke coil comprising:

a magnetic core including a core section and first and second flange sections arranged at both ends of the core section;

external electrodes located on each of the first and second flange sections;

a pair of coils wound around the core section with each of the coils having one end starting at the first flange section and the other end terminated at the second flange section, the ends of the coils being routed to and connected to the external electrodes;

a magnetic plate with a surface thereof facing the pair of coils and bonded to side surfaces of the first and second flange sections; and a metal film disposed on at least the surface of the magnetic plate facing the pair of coils; wherein a gap is arranged in the metal film so as to segment the metal film into a first metal film section and a second metal film section with the first metal film section and the second metal film section being electrically disconnected, and corresponding to a winding starting portion and a winding terminating portion of the pair of coils, respectively.

2. The common-mode choke coil according to claim 1, wherein the metal film is made of a ferromagnetic body containing at least one selected from the group consisting of iron, cobalt, nickel, chromium, manganese, and copper.

3. The common-mode choke coil according to claim 2, wherein the metal film is made of a ferromagnetic alloy containing as a main component one of an alloy of nickel and chromium and an alloy of nickel and copper.

4. The common-mode choke coil according to claim 1, wherein the gap has a band-shaped configuration with a width direction thereof aligned with a winding axis direction of the pair of coils and a length direction thereof aligned with a direction perpendicular or substantially perpendicular to the winding axis direction of the pair of coils.

5. The common-mode choke coil according to claim 1, wherein the gap is arranged at an approximate center position between the winding starting portion and the winding terminating portion.

6. The common-mode choke coil according to claim 1, wherein each of the magnetic core and the magnetic plate is made of ferrite.

7. The common-mode choke coil according to claim 1, further comprising an adhesive arranged to bond the magnetic plate to the side surfaces of the first and second flange sections.

8. The common-mode choke coil according to claim 7, wherein the adhesive contains magnetic powder.

* * * * *